US005151745A

United States Patent [19]

Durland et al.

[11] Patent Number: 5,151,745

[45] Date of Patent: Sep. 29, 1992

[54] SHEET CONTROL MECHANISM FOR USE IN AN ELECTROPHOTOGRAPHIC PRINTING MACHINE

[75] Inventors: Scott C. Durland, Rochester; James R. Cassano, Penfield; Richard M. Dastin; Roger M. Swanson, both of Fairport, all of N.Y.

[73] Assignee: Xerox Corporation, Stamford, Conn.

[21] Appl. No.: 755,466

[22] Filed: Sep. 5, 1991

[51] Int. Cl.[5] ..... G03G 21/00

[52] U.S. Cl. ..... 355/313; 271/225; 271/277; 271/301; 271/308; 355/308; 355/309; 355/321

[58] Field of Search ..... 355/313, 314, 317, 321, 355/308, 309, 315; 271/275, 277, 301, 198, 184, 307-308, 225

[56] References Cited

U.S. PATENT DOCUMENTS

| | | | |
|---|---|---|---|
| 3,999,987 | 12/1976 | Davis et al. | 96/1.2 |
| 4,073,489 | 2/1978 | Idstein et al. | 271/277 |
| 4,641,830 | 2/1987 | Okuda et al. | 271/274 |
| 4,761,003 | 8/1988 | Barrois et al. | 271/277 X |

FOREIGN PATENT DOCUMENTS

| | | | |
|---|---|---|---|
| 0170346 | 10/1982 | Japan | 271/275 |
| 0070260 | 4/1983 | Japan . | |
| 0014267 | 1/1985 | Japan . | |
| 0259954 | 11/1987 | Japan . | |

*Primary Examiner*—A. T. Grimley
*Assistant Examiner*—Matthew S. Smith
*Attorney, Agent, or Firm*—Paul J. Maginot

[57] ABSTRACT

An apparatus for advancing a sheet in a predetermined path is described. The apparatus includes a mechanism for advancing the sheet in the path. The apparatus further includes a first mechanism for controlling movement of the sheet while it is being advanced in the path, the first controlling mechanism being in contact with the sheet in a first mode of operation and being spaced apart from the sheet in a second mode of operation. Moreover, the apparatus includes a second mechanism for controlling movement of the sheet while it is being advanced in the path, the second controlling mechanism being in contact with the sheet in a first mode of operation and being spaced apart from the sheet in a second mode of operation. The apparatus additionally includes an intermediate member movable between a first location and a second location, each of the controlling mechanisms being positioned in one of its respective modes of operation in response to the intermediate member being positioned at its first location and being positioned in the other of its respective modes of operation in response to the intermediate member being positioned at its second location.

8 Claims, 17 Drawing Sheets

SHEET CONTROL MECHANISM FOR USE IN AN ELECTROPHOTOGRAPHIC PRINTING MACHINE

This invention relates generally to an electrophotographic printing machine and, more particularly, concerns a sheet transport apparatus for use in an electrophotographic printing machine.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed in an imaging zone to a light source such as a raster output scanner. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. Generally, the developer material comprises toner particles adhering triboelectrically to carrier granules. The toner particles are attracted to the latent image from the carrier granules to form a toner image on the photoconductive member which is subsequently transferred to a copy sheet. The copy sheet is then heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray to a recirculating path internal the printing machine where a plurality of toner images are transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips the leading edge of the copy sheet and moves the sheet in a recirculating path so that accurate multi-pass color registration is achieved. In this way, magenta, cyan, yellow, and black toner images are transferred to the copy sheet in registration with one another.

Various systems which have been designed for transporting a copy sheet in a predetermined path have a number of devices which function to affect and control movement of the sheet while it is being advanced in its path within the printing machine. Examples of such sheet control devices include a sheet gripper and a sheet guide. Some of these sheet control devices are fixed at various stationary locations adjacent the path of movement of the sheet and consequently act on the sheet as the sheet is being transported adjacent each stationary sheet control device. Other such devices are moved in and out of an operative position by a solenoid or other force applying mechanism. Some systems have multiple sheet control devices which are moved in and out of an operative position, each being moved by a separate and distinct solenoid or other force applying mechanism. In the latter situation, a significant amount of space is required to house the multiple solenoids or other force applying mechanisms in the sheet transport apparatus. Moreover, each solenoid or other similar mechanism possesses a significant financial cost and therefore the need for multiple solenoids or other similar mechanisms results in the sheet transport apparatus being relatively financially expensive. The following disclosures may be relevant to various aspects of the present invention:

U.S. Pat. No. 3,999,987
Patentee: Davis et al.
Issued: Dec. 28, 1976

U.S. Pat. No. 4,073,489
Patentee: Idstein et al.
Issued: Feb. 14, 1978

The relevant portions of the foregoing disclosures may be briefly summarized as follows:

U.S. Pat. No. 3,999,987 describes a multi-color electrostatic printing machine having processing components adapted to produce an image for each color of an original being copied. The printing machine includes movable gripping fingers for releasably gripping a sheet of paper. The printing machine further includes fixed stripout fingers for removing the sheet of paper from adjacent a photoconductive drum.

U.S. Pat. No. 4,073,489 discloses a device for transporting an original to be copied while resting on a supporting surface, preferably a drum, in a reproduction apparatus. The device includes a control unit serving to turn a gripper shaft which includes a cam member on whose top edge an actuating roller rides and moves a control lever up and down so that the gripper shaft is turned for opening or closing a set of gripper fingers.

In accordance with one aspect of the present invention, there is provided an apparatus for advancing a sheet in a predetermined path. The apparatus includes a mechanism for advancing the sheet in the path. The apparatus further includes a first mechanism for controlling movement of the sheet while it is being advanced in the path, the first controlling mechanism being in contact with the sheet in a first mode of operation and being spaced apart from the sheet in a second mode of operation. Moreover, the apparatus includes a second mechanism for controlling movement of the sheet while it is being advanced in the path, the second controlling mechanism being in contact with the sheet in a first mode of operation and being spaced apart from the sheet in a second mode of operation. The apparatus additionally includes an intermediate member movable between a first location and a second location, each of the controlling mechanisms being positioned in one of its respective modes of operation in response to the intermediate member being positioned at its first location and being positioned in the other of its respective modes of operation in response to the intermediate member being positioned at its second location.

Pursuant to another aspect of the present invention, there is provided a printing machine of the type having a toner image developed on a moving member with a sheet being advanced in a predetermined path through a transfer zone and into registration with the toner image. The printing machine includes a mechanism for advancing the sheet in the path. The printing machine further includes a first mechanism for controlling movement of the sheet while it is being advanced in the path, the first controlling mechanism being in contact with the sheet in a first mode of operation and being spaced apart from the sheet in a second mode of operation. Moreover, the printing machine includes a second mechanism for controlling movement of the sheet while it is being advanced in the path, the second controlling mechanism being in contact with the sheet in a first mode of operation and being spaced apart from the sheet in a second mode of operation. The printing machine additionally includes an intermediate member movable between a first location and a second location, each of the controlling mechanisms being positioned in one of its respective modes of operation in response to the intermediate member being positioned at its first location and being positioned in the other of its respective modes of operation in response to the intermediate member being positioned at its second location.

Other features of the present invention will become apparent as the following description proceeds and upon reference to the drawings, in which.

Figure 1:
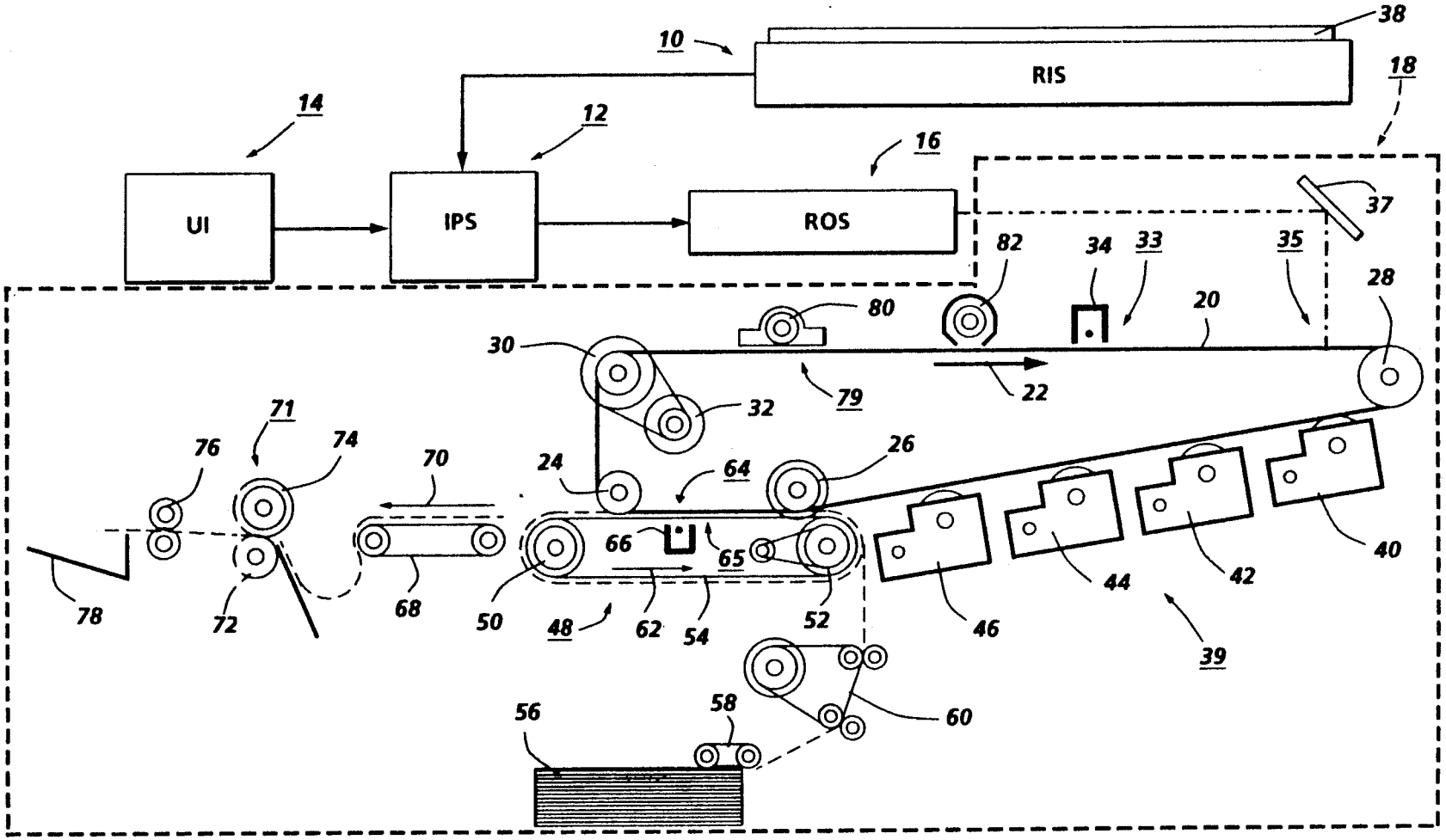
FIG. 1 is a schamatic elevational view showing an electrophotographic printing machine incorporating the features of the present invention therein.
Figure 16:
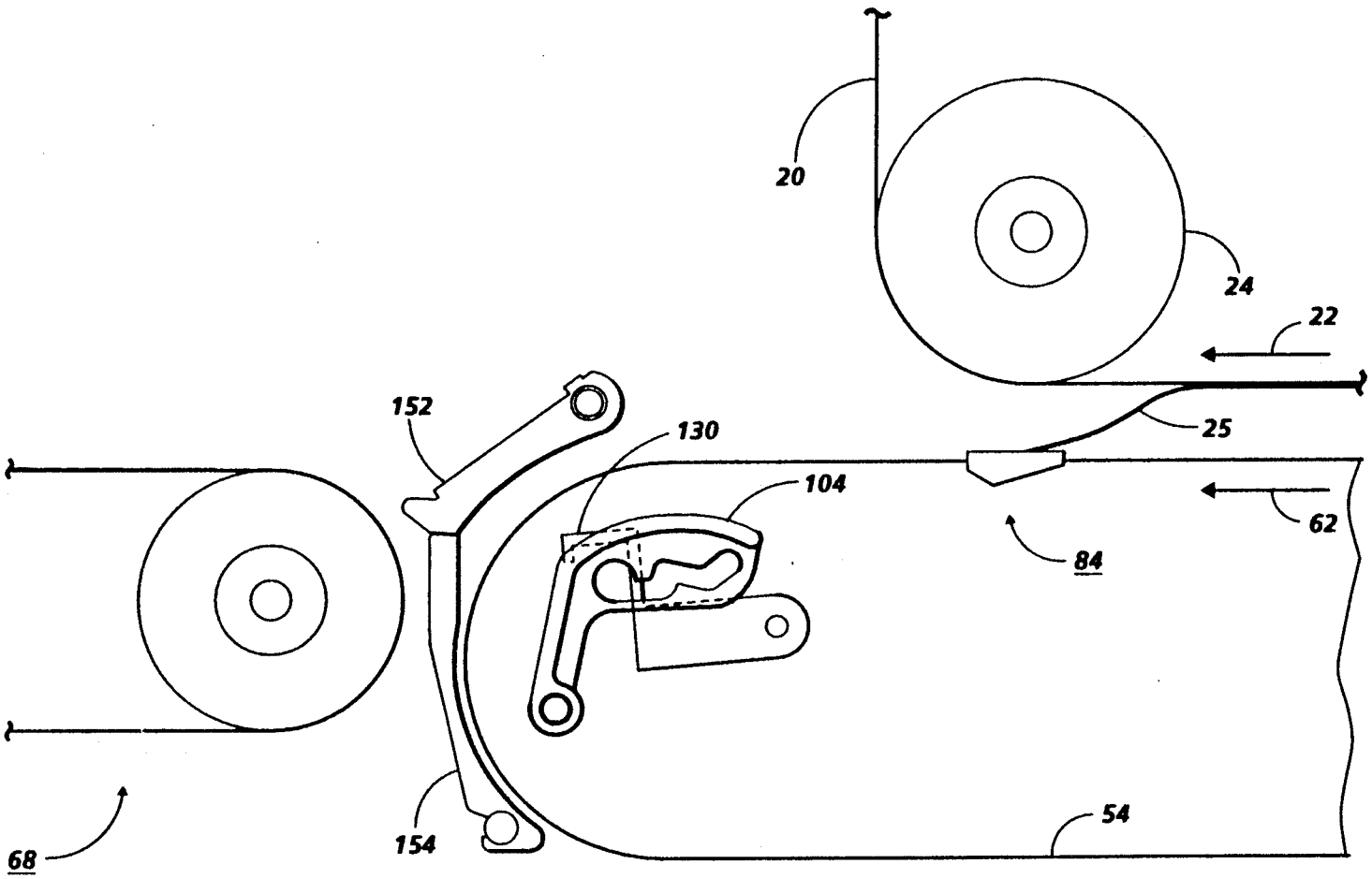
FIG. 16 is a schematic elevational view of the cam arm of the cam mechanism, the baffle of the sheet release mechanism, and the movable guide member of the trial edge guide mechanism of the sheet transport system used in the electrophotographic printing machine of FIG. 1, each being shown in one of its respective positions.
Figure 17:
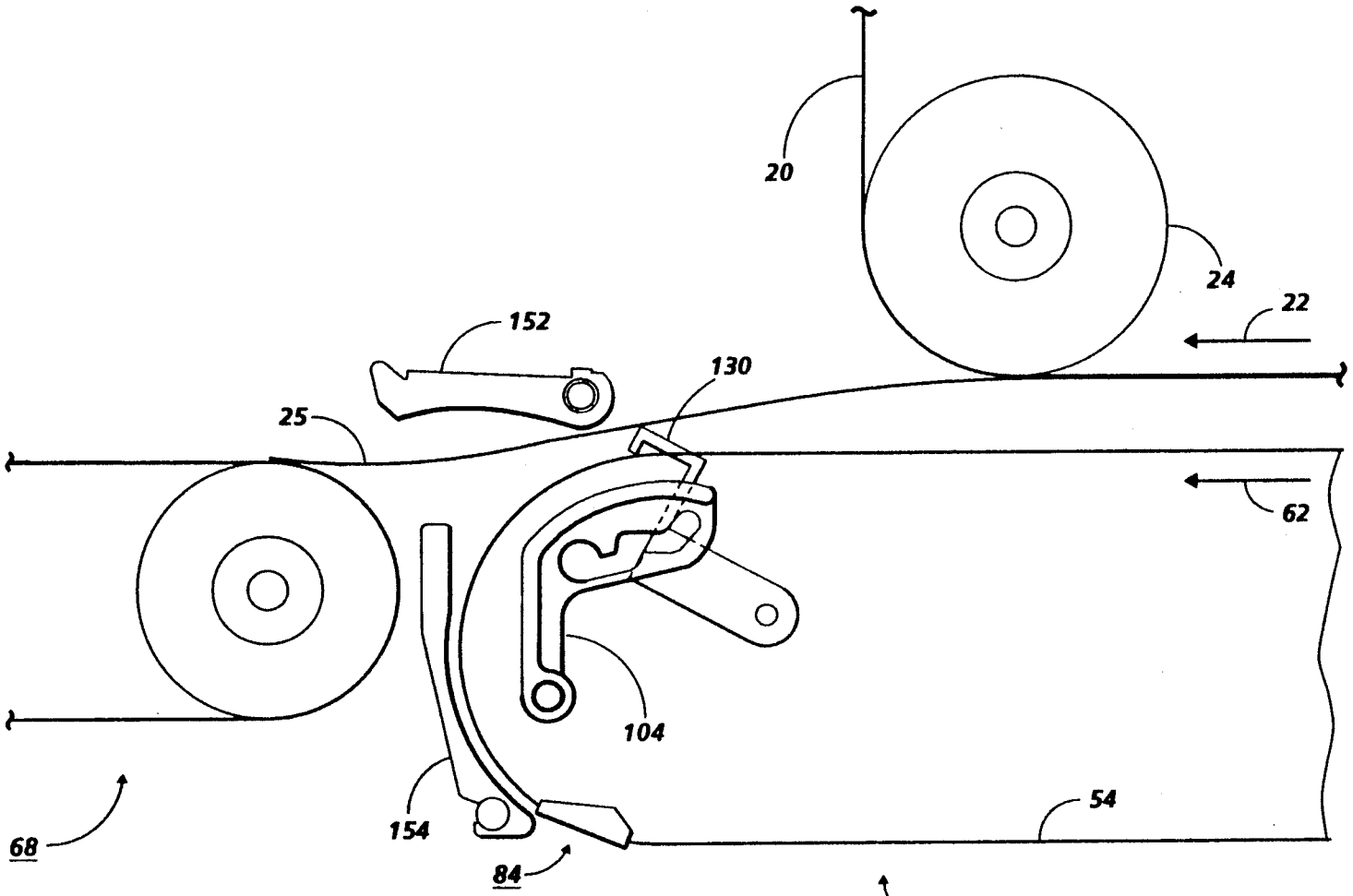
Figure 18:
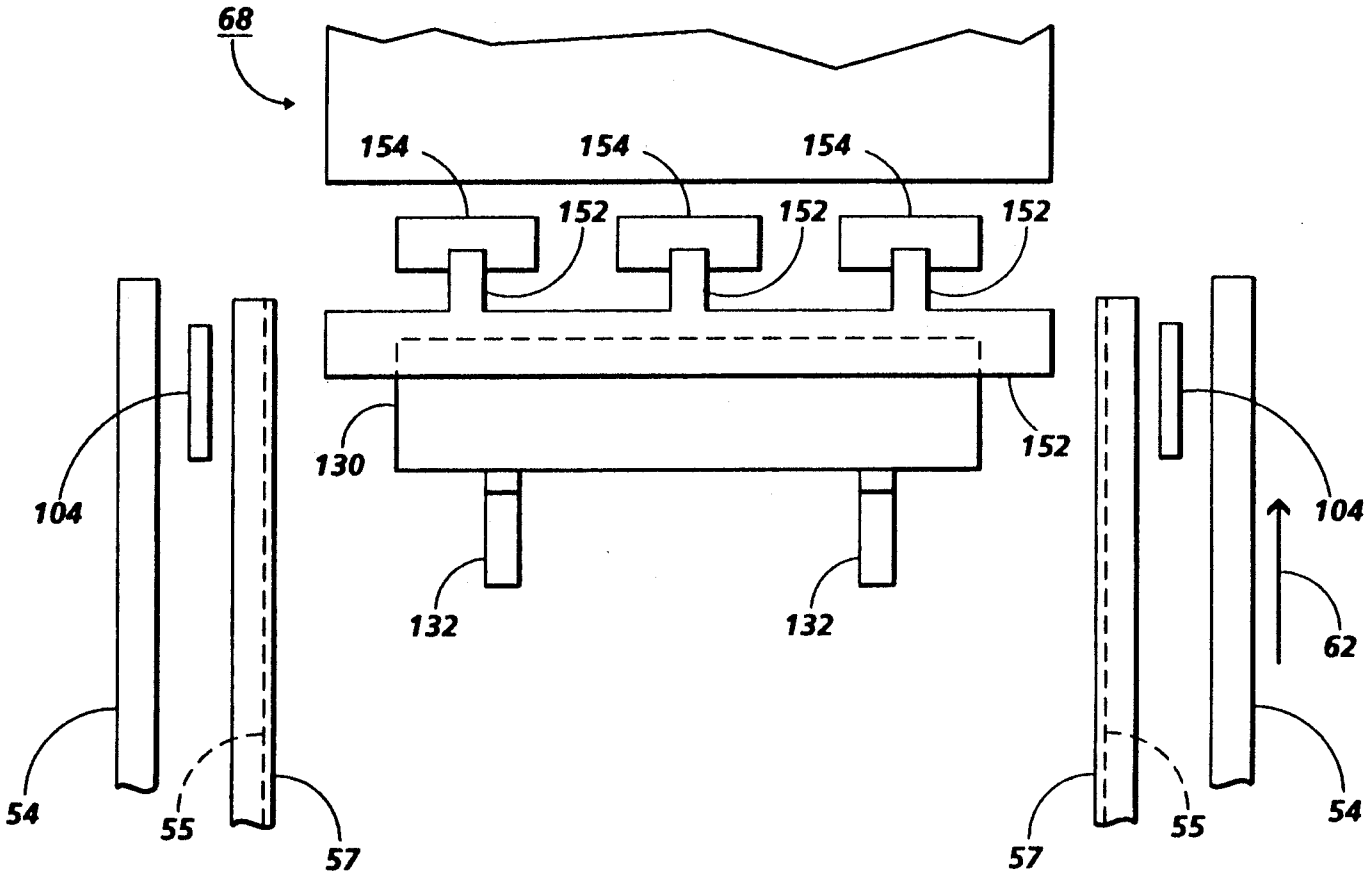

FIG. 17 is a schematic elevational view of the cam arm of the cam mechanism, the baffle of the sheet release mechanism, and the movable guide member of the trial edge guide mechanism of the sheet transport system used in the electrophotographic printing machine of FIG. 1, each being shown in the other of its respective positions; and FIG. 18 is a schematic planar view showing the cam arm of the cam mechanism, the baffle of the sheet release mechanism, and the movable guide member of the trial edge guide mechanism, each being shown in its respective position of FIG. 16.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station indicated generally by the reference numeral 35. Exposure station 35 receives a modulated light beam corresponding to information derived by RIS 10 having a multi-colored original document 38 positioned thereat. The modulated light beam impinges on the surface of photoconductive belt 20. The beam illuminates the charged portion of photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is contantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is positioned substantially adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper 84 (see FIGS. 2–4) extends between belts 54 and moves in unison therewith. A sheet 25 (see FIG. 2) is advanced from a stack of sheets 56 disposed on a tray. A friction retard feeder 58 advances the uppermost sheet from stack 56 onto a pretransfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multi-color copy of the colored original document.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
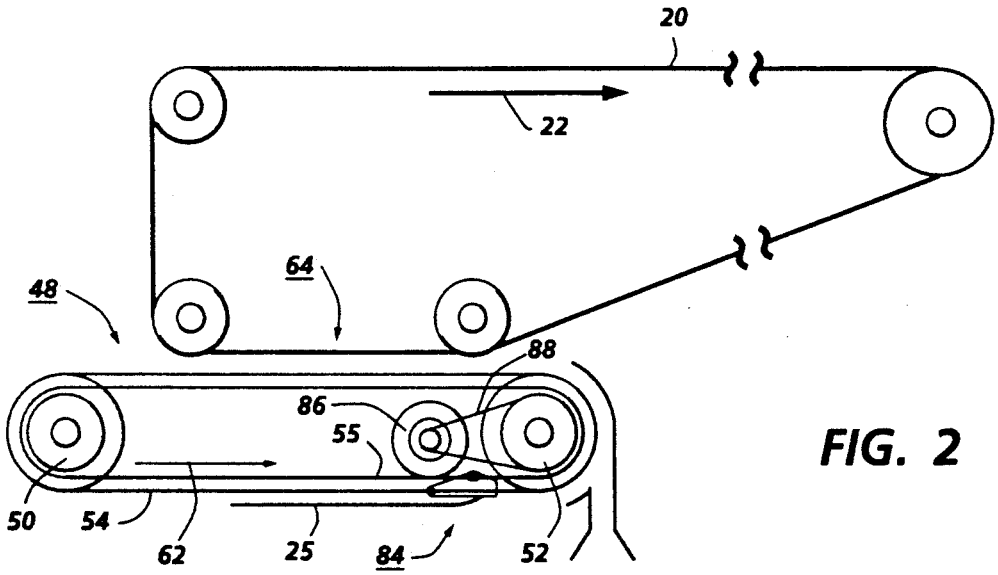
FIG. 2 is a schematic elevational view showing further details of the sheet transport system used in the electrophotographic printing machine of FIG. 1.
Figure 3:
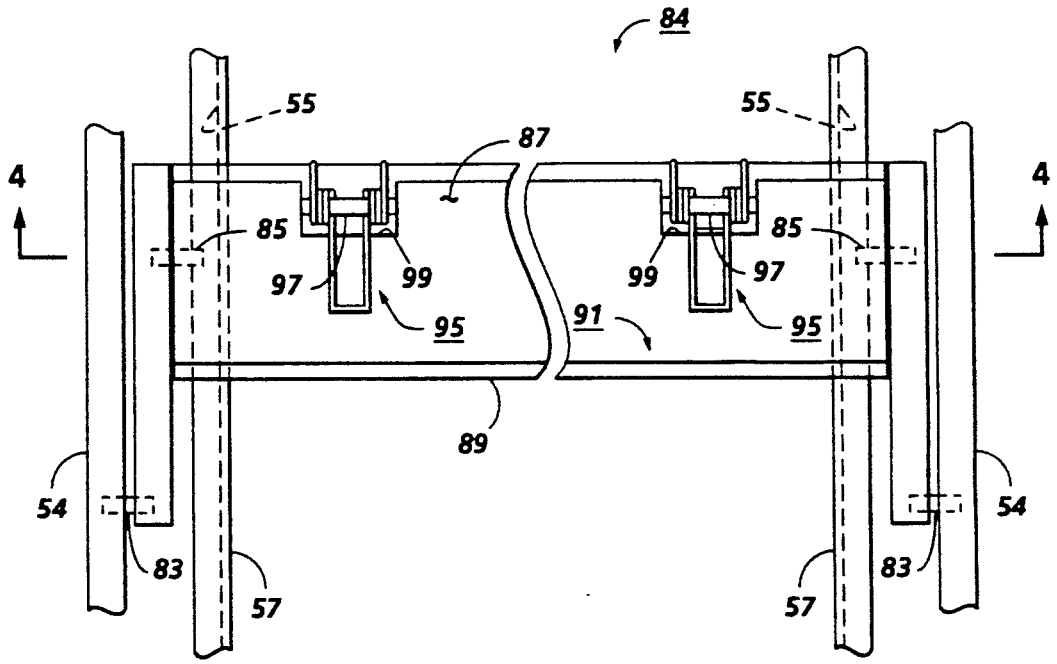
FIG. 3 is a schematic planar view showing the sheet gripper of the sheet transport system used in the electrophotographic printing machine of FIG. 1.
Figure 4:
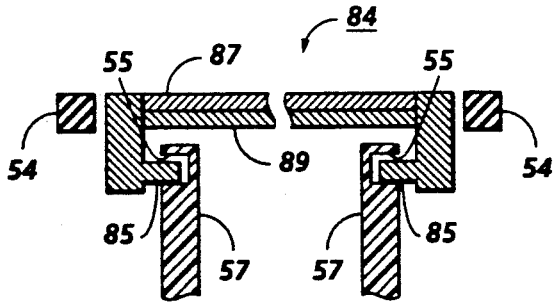
FIG. 4 is a sectional elevational view taken in the direction of arrows 4—4 in FIG. 3 of the opposed side marginal regions of the sheet gripper.

FIG. 2 shows sheet gripper 84 of sheet transport 48 transporting sheet 25 in the direction of arrow 62 in a recirculating path of movement. FIG. 3 shows sheet gripper 84 suspended between two spaced apart timing belts 54. FIG. 4 shows a sectional elevational view of the opposed side marginal regions of sheet gripper 84. Referring to FIGS. 2–4, timing belts 54 are entrained about rollers 50 and 52. Belts 54 define a continuous path of movement of sheet gripper 84. A motor 86 is coupled to roller 52 by a drive belt 88. Sheet gripper 84 includes a pair of guide members 85. A pair of spaced apart and continuous tracks 55 are respectively positioned substantially adjacent belts 54. Tracks 55 are respectively defined by a pair of track supports 57. Each of guide members 85 are slidably positioned within a respective track 55. Sheet gripper 84 further includes an upper sheet gripping portion 87 and a lower sheet gripping portion 89 which are biased toward each other by a plurality of springs, each being generally indicated by the reference numeral 95 as shown in FIG. 3. A plurality of securing pins 97 are respectively positioned within a plurality of apertures 99 of upper gripping portion 87 and secured thereto to hold springs 95 in place so as to bias upper gripping portion 87 toward lower gripping portion 89.

The sheet gripper further includes a pair of cam followers 100 (see FIGS. 5–7) which are attached to the opposed side marginal regions of upper gripping portion 87 and function with a pair of cam arms 104 (see also FIGS. 5–7) to displace upper gripping portion 87 relative to lower gripping portion 89 to open and close the sheet gripper at predetermined intervals. In the closed position, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91 (see FIG. 3). A silicone rubber coating (not shown) may be positioned upon lower sheet gripping portion 89, near gripping nip 91, in order to increase the frictional grip of sheet 25 between the gripping portions. Belts 54 are respectively connected to the opposed side marginal regions of sheet gripper 84 by a pair of pins 83 as shown in FIG. 3. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected.

Three mechanisms will be described below each which affect and control movement of the sheet while it is being advanced in its path within printer 18. While, each mechanism will be described separately below, it will be understood that all three mechanisms are employed concurrently to affect and control movement of the sheet at various times during advancement thereof within the printing machine. FIGS. 16–18 depict simultaneous use of the three sheet controlling mechanisms.

Figure 5:
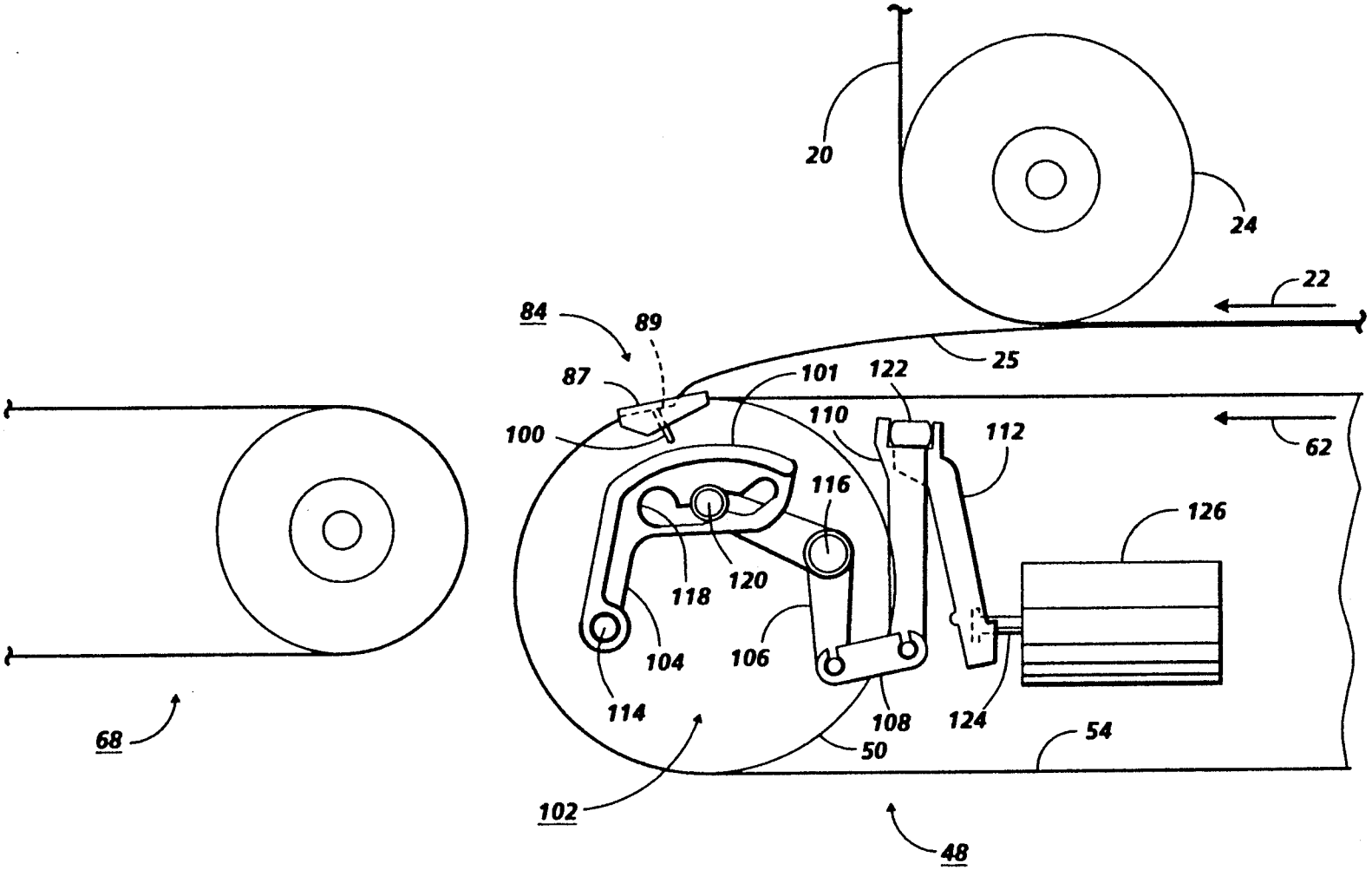
FIG. 5 is a schematic elevational view of one of the cam mechanisms of the sheet transport system used in the electrophotographic printing machine of FIG. 1 wherein the cam arm of the cam mechanism is shown in a first position and further showing the sheet gripper gripping the sheet.
Figure 6:
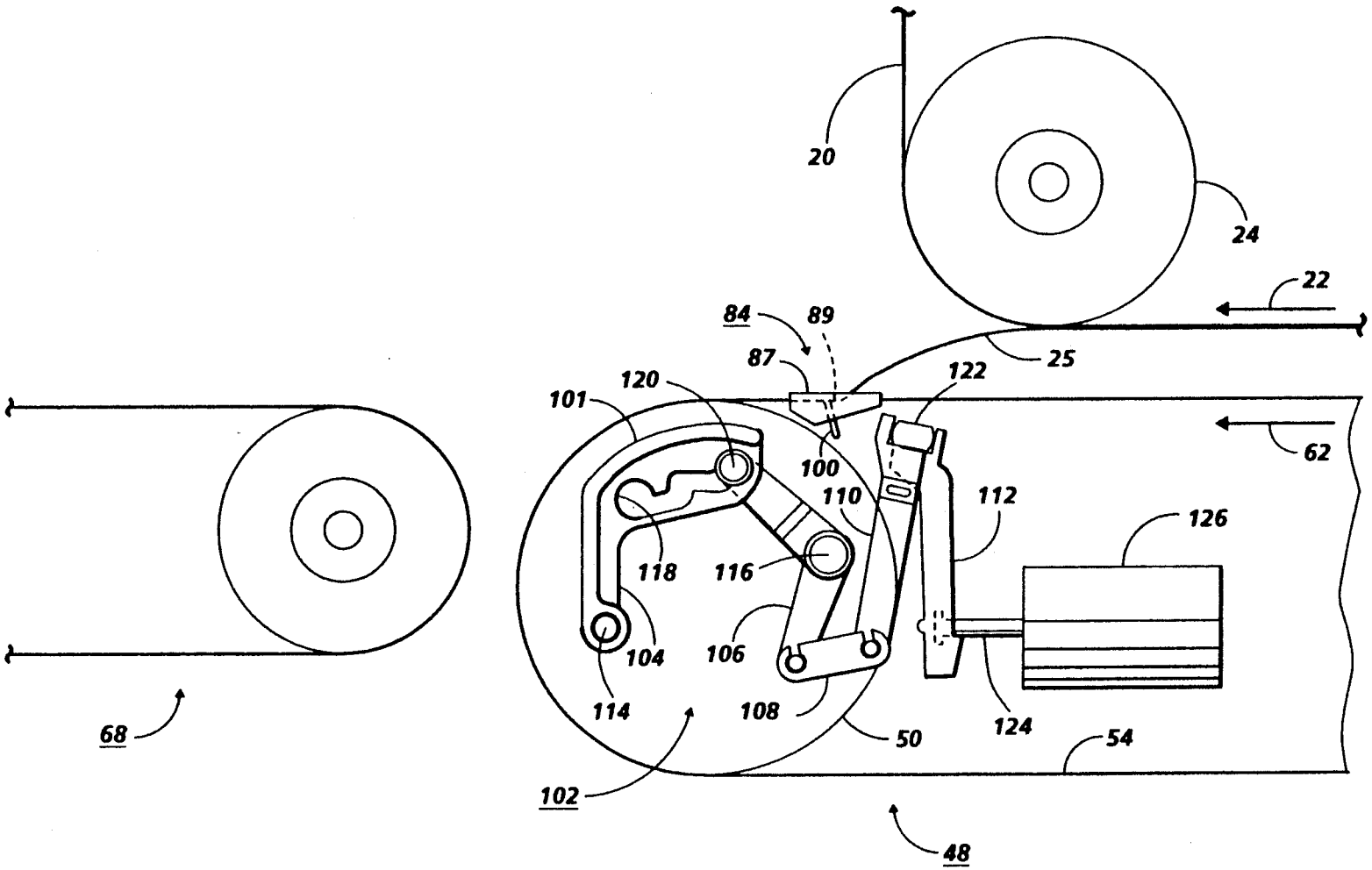
FIG. 6 is a schematic elevational view of the cam mechanism of FIG. 5 wherein the cam arm of the cam mechanism is shown in a second position and further showing the sheet gripper gripping the sheet.
Figure 7:
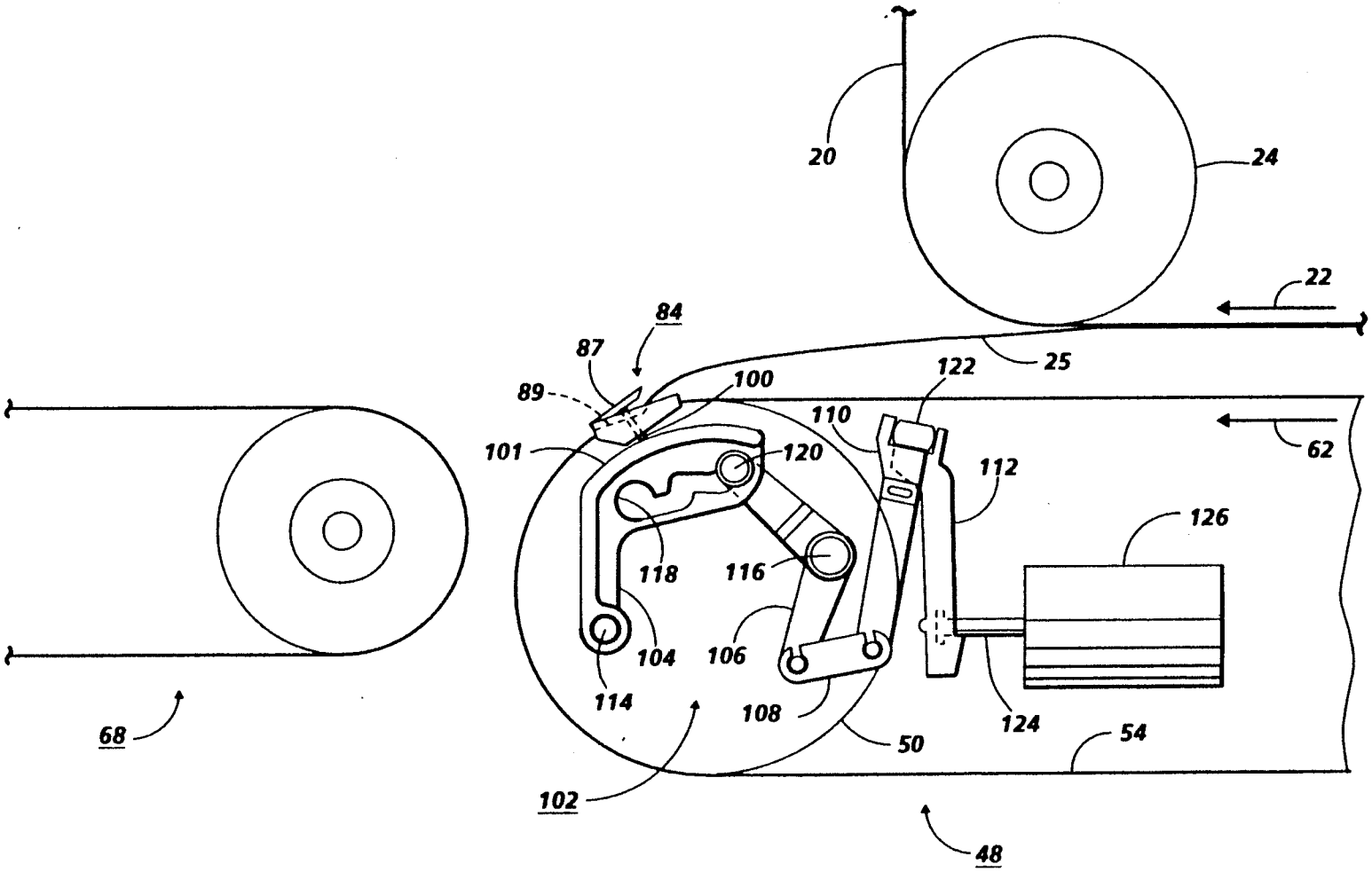
FIG. 7 is a view similar to FIG. 6 but showing the sheet gripper opened to release the sheet.

A first mechanism for controlling movement of the sheet while it is being advanced in its path is shown in FIGS. 5–7. More specifically, sheet transport system 48 includes a pair of cam mechanisms, generally indicated by the reference numeral 102. The cam mechanisms are spaced apart and moreover each is positioned near a respective track 55 (tracks 55 are not shown in FIGS. 5–7). Since cam mechanisms 102 are substantially similar in structure and moreover function substantially the same, only one of the cam mechanisms will be described in detail.

Cam mechanism 102 includes cam arm 104, a first cam link 106, a second cam link 108, a third cam link 110 and a fourth cam link 112. Cam arm 104 is pivotable about a first stationary shaft 114 while first cam link 106 is pivotable about a second stationary shaft 116. A cam surface 101 is defined on cam arm 104 and further a cam profile 118 is defined in cam arm 104. First cam link 106 includes a nodule 120 which is slidably positioned within cam profile 118. Second cam link 108 is pivotably secured at one of its ends to first cam link 106 and its other end to third cam link 110. Third cam link 110 is further secured to a rotatable shaft 122. Also secured to rotatable shaft 122 is fourth cam link 112. Fourth cam link 112 is further secured to a force output shaft 124 of a solenoid 126 as shown in FIG. 5. When solenoid 126 is in one mode of operation, shaft 124 of the solenoid is positioned so as to maintain cam arm 104, via cam links 106, 108, 110 and 112, out of contact with cam follower 100 of sheet gripper 84. Consequently, upper gripping portion 87 is prevented from being displaced relative to lower sheet gripping portion 89 against the bias of springs 95 as sheet gripper 84 passes over cam arm 104.

After the sheet gripper has began its third successive cycle, solenoid 126 is actuated to assume another mode of operation. In this mode of operation, shaft 124 is forced to assume another position as shown in FIG. 6. As shaft 124 is forced from its position shown in FIG. 5 to its position shown in FIG. 6, cam arm 104 is forced from its position shown in FIG. 5 to its position shown in FIG. 6. When solenoid 126 is in this mode of operation, shaft 124 of the solenoid is positioned so as to locate cam arm 104, via cam links 106, 108, 110 and 112, to be in the path of cam follower 100 of sheet gripper 84 thereby causing upper gripping portion 87 to be displaced relative to lower sheet gripping portion 89 against the bias of springs 95 as sheet gripper 84 passes over cam arm 104 as shown in FIG. 7.

Cam mechanism 102 directs substantially all of the force applied by springs 95 to first stationary shaft 114 and second stationary shaft 116 via cam arm 104 and first cam link 106, respectively, when cam follower 100 is in contact with cam surface 101. Consequently, shaft 124 of solenoid 126 is isolated from substantially all of the force applied by springs 95 when cam follower 100 is in contact with cam surface 101.

Figure 8:
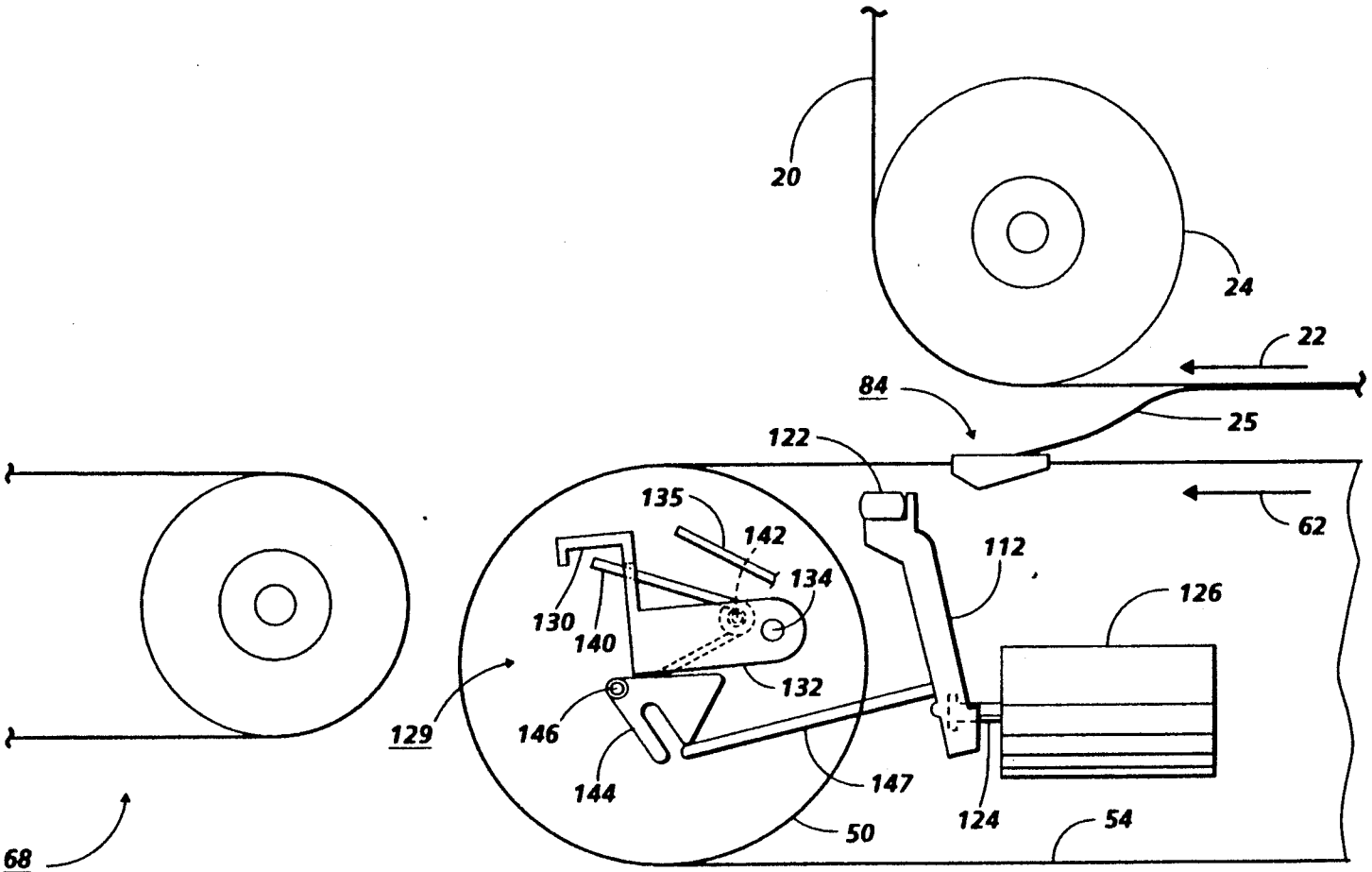
FIG. 8 is a schematic elevational view of the sheet release mechanism of the sheet transport system used in the electrophotographic printing machine of FIG. 1 with the baffle of the sheet release mechanism shown in a first position.
Figure 9:
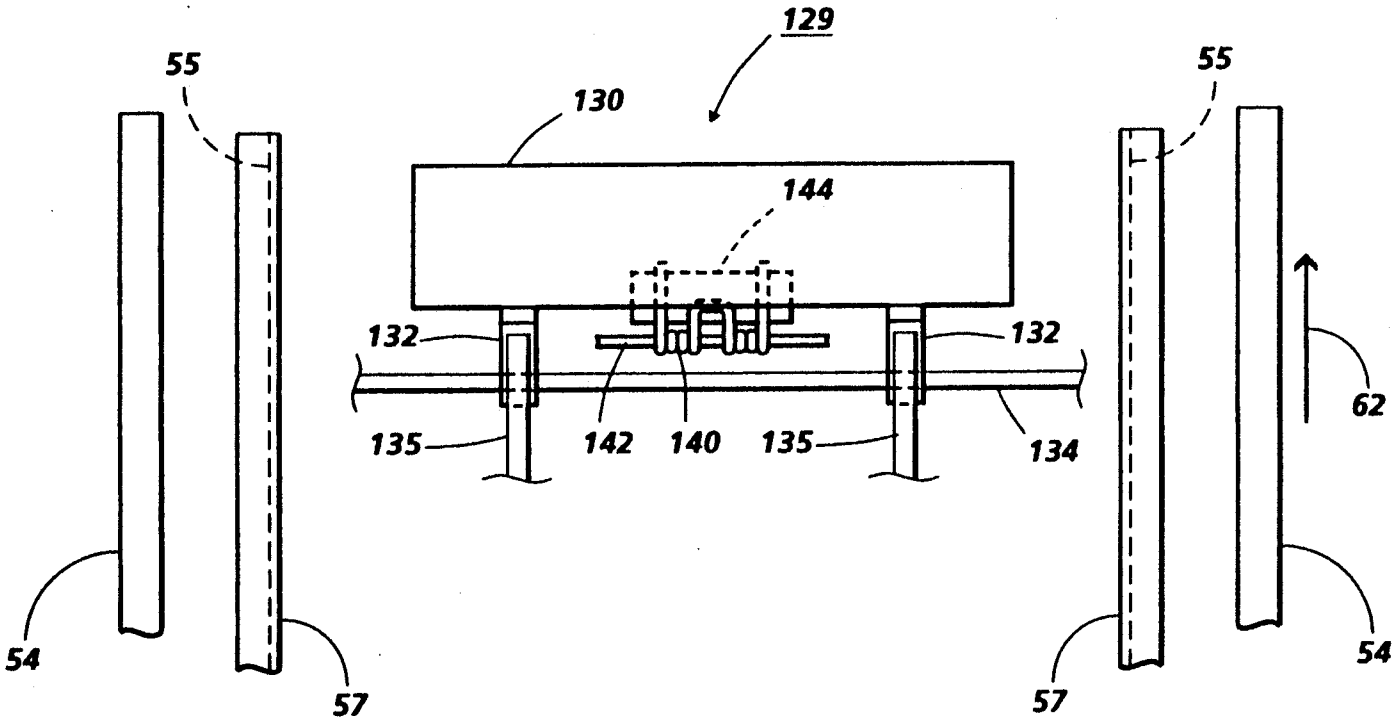
FIG. 9 is a schematic planar view showing the sheet release mechanism of the sheet transport system of FIG. 8.
Figure 10:
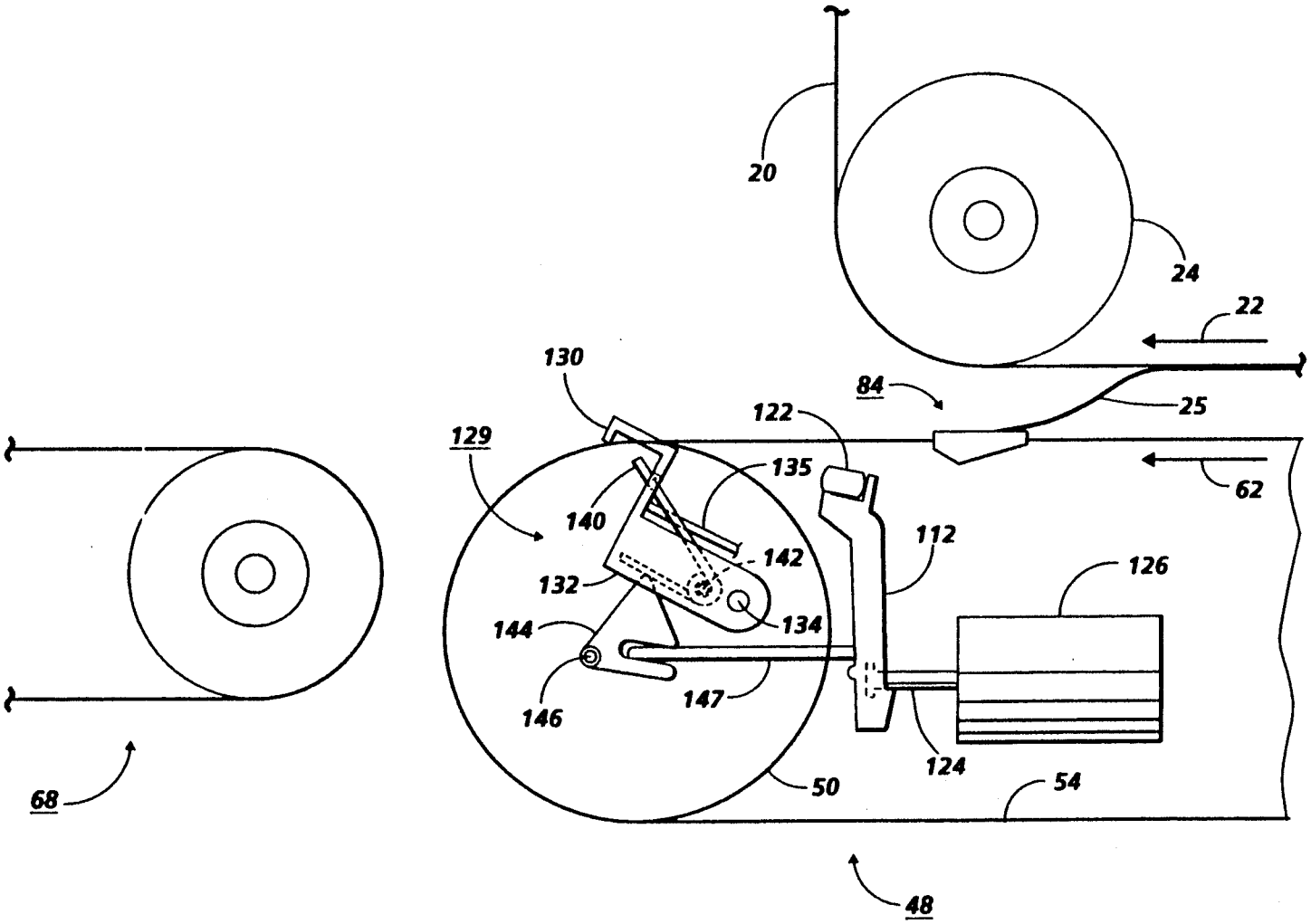
FIG. 10 is a schematic elevational view of the sheet release mechanism of the sheet transport system used in the electrophotographic printing machine of FIG. 1 with the baffle of the sheet release mechanism shown in a second position.

A second mechanism which controls movement of the sheet while it is being advanced in its path is shown in FIGS. 8–12. In particular, sheet transport mechanism 48 further includes a sheet release mechanism, indicated generally by the reference numeral 129, for effecting release of sheet 25 from sheet gripper 84 at a point near the end of the transfer process. Sheet release mechanism 129 includes a baffle 130 which is connected to a pair of brackets 132. Baffle 130 has a length substantially equal to the width of sheet 25. Brackets 132 are pivotably mounted on an a stationary shaft 134. As a result, baffle 130 is pivotable between a first position as shown in FIG. 8 and a second position as shown in FIG. 10.

Operatively associated with baffle 130 is a spring 140 and an intermediate release link 144. Spring 140 is pivotably mounted on a stationary shaft 142 while release link 144 is rotatably mounted on a stationary shaft 146. A pivot link 147 is operatively associated at one of its ends with release link 144 and is secured at its other end to forth cam link 112. As solenoid 126 forces shaft 124 from its position shown in FIG. 8 to its position shown in FIG. 10, release link 144 is forced, via forth cam link 112 and pivot link 147, to rotate in a counterclockwise manner from its position shown in FIG. 8 to its position shown in FIG. 10. Correspondingly, when release link 144 is located at its position shown in FIG. 8, baffle 130 is located at its position shown in FIG. 8. However, when release link 144 is forced to rotate to its position shown in FIG. 10, baffle 130 is correspondingly forced to move to its position shown in FIG. 10. The above movement of baffle 130 is a result of force applied thereto by release link 144 which is transmitted via spring 140. Baffle 130 is prevented from moving beyond its position shown in FIG. 10 by a pair of stops 135.

FIG. 8 shows sheet release mechanism 129 with baffle 130 spaced apart from the path of sheet gripper 84 and sheet 25. Thus, as sheet gripper 84 transports sheet 25 in its recirculating path of movement, baffle 130 is positioned so as not to physically contact sheet gripper 84 or sheet 25. However, after the sheet gripper has began its third successive cycle, a control system (not shown) activates solenoid 126 to reposition shaft 124 thereby causing baffle 130 to assume its position as shown in FIG. 10. At this position, baffle 130 is located within the path of sheet gripper 84 and sheet 25. Therefore, as sheet gripper 84 transports sheet 25 in its path of movement, baffle 130 is positioned to physically contact sheet gripper 84 and sheet 25. In FIG. 10, sheet gripper 84 is shown transporting sheet 25 in the direction of arrow 62 at a location in its path of movement prior to physical contact with baffle 130. Note that at this location of the sheet gripper, a portion of sheet 25 is tacked to photoconductive belt 20.

Figure 11:
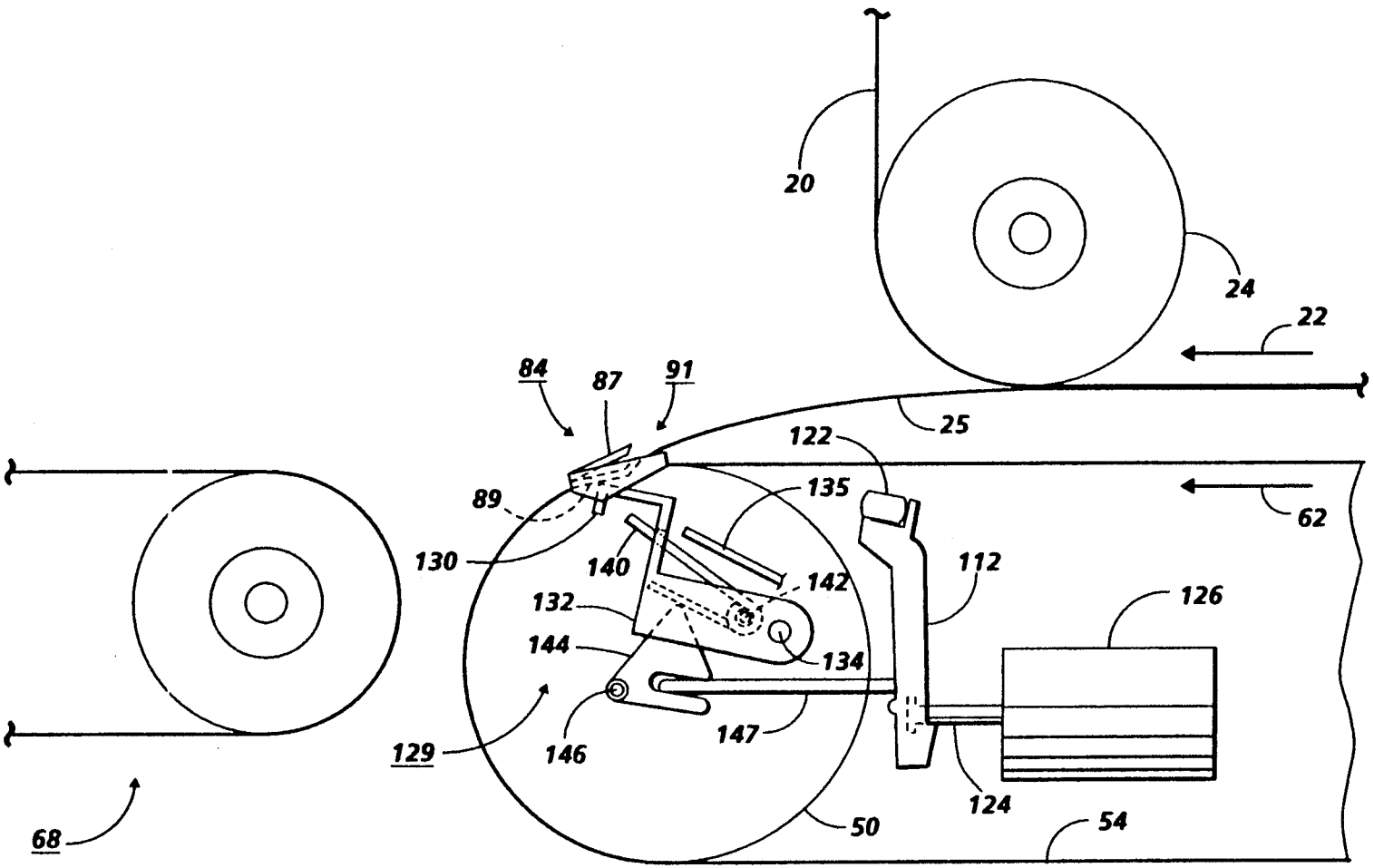
FIG. 11 is a schematic elevational view of the sheet release mechanism of the sheet transport system used in the electrophotographic printing machine of FIG. 1 with the sheet gripper shown in contact with the baffle of the sheet release mechanism.

As sheet gripper 84 continues to travel in the direction of arrow 62, lower gripping portion 89 of sheet gripper 84 contacts baffle 130 and urges it downward against the bias of spring 140 as shown in FIG. 11. At this time, upper gripping portion 87 of sheet gripper 84 is in the open position. Again, note that a portion of sheet 25 is tacked to photoconductive belt 20 at this sheet gripper location. Since sheet 25 is tacked to photoconductive belt 20 and the photoconductive belt is moving in the direction of arrow 22 at the same speed or slightly faster than sheet gripper 84, the leading portion of the sheet remains within nip 91 of sheet gripper 84.

Figure 12:
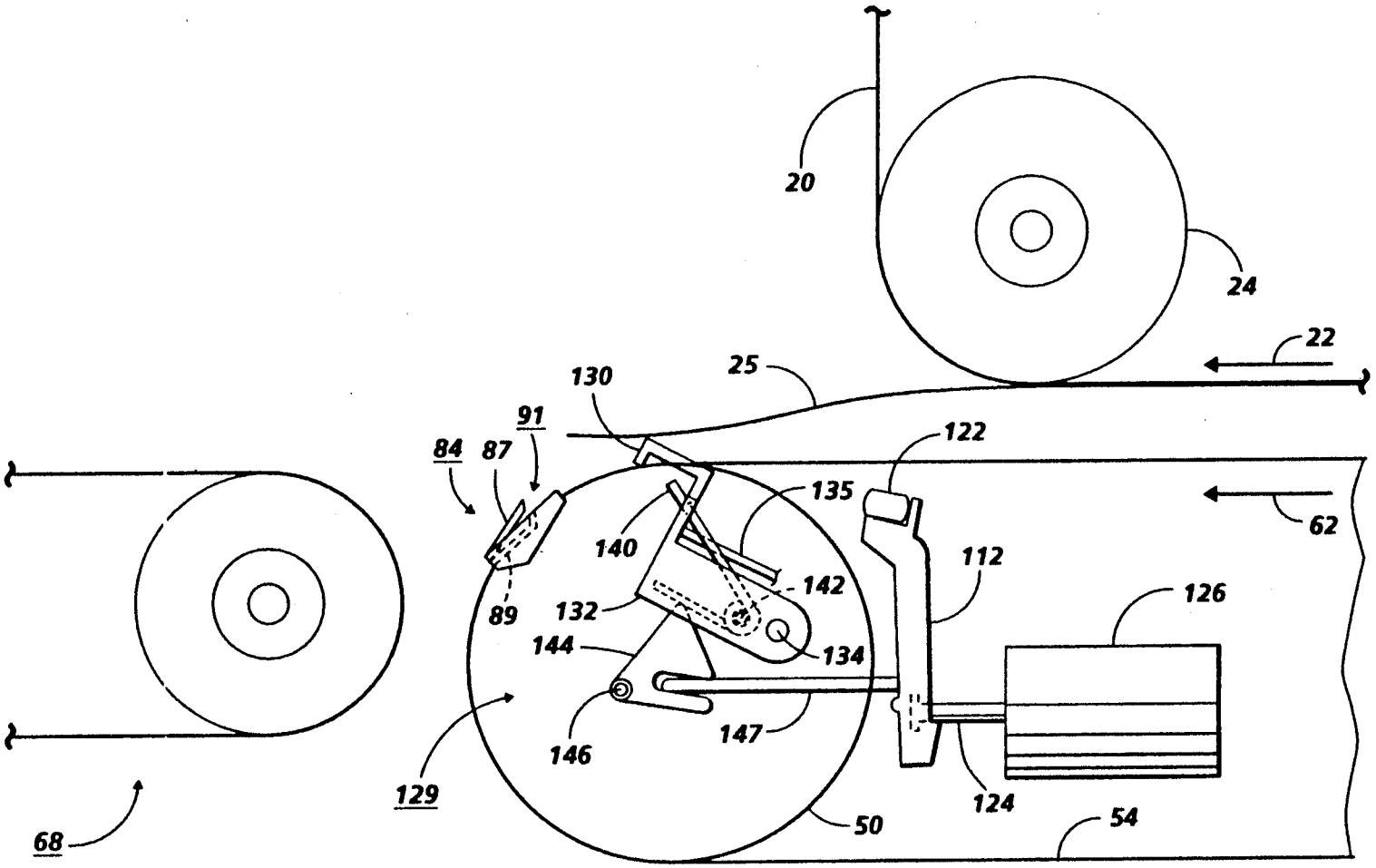
FIG. 12 is a schematic elevational view of the sheet release mechanism of the sheet transport system used in the electrophotographic printing machine of FIG. 1 with the sheet gripper shown subsequent to contact with the baffle of the sheet release mechanism and the sheet shown released from the sheet gripper.

Once the trailing edge of sheet gripper 84 passes over the leading edge of baffle 130, the baffle springs back to its position as shown in FIG. 12 thereby contacting sheet 25 to force the leading portion of the sheet out of nip 91 of sheet gripper 84. Baffle 130 then functions to guide sheet 25 toward vacuum transport 68. Vacuum transport 68 then conveys sheet 25 to fuser station 71 (see FIG. 1).

Figure 13:
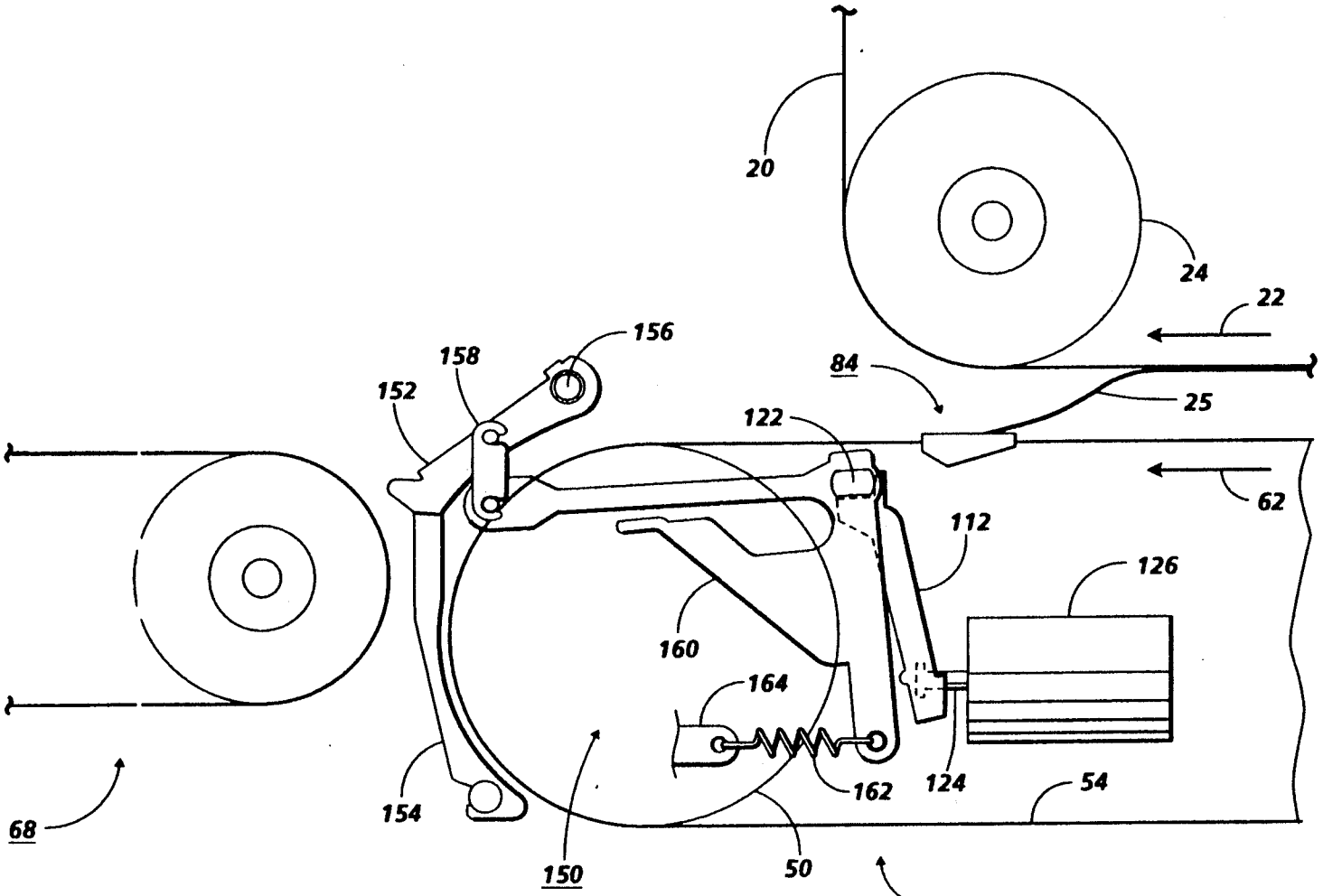
FIG. 13 is a schematic elevational view of the trail edge guide mechanism of the sheet transport system used in the electrophotographic printing machine of FIG. 1 with the movable guide member shown in a first position.
Figure 14:
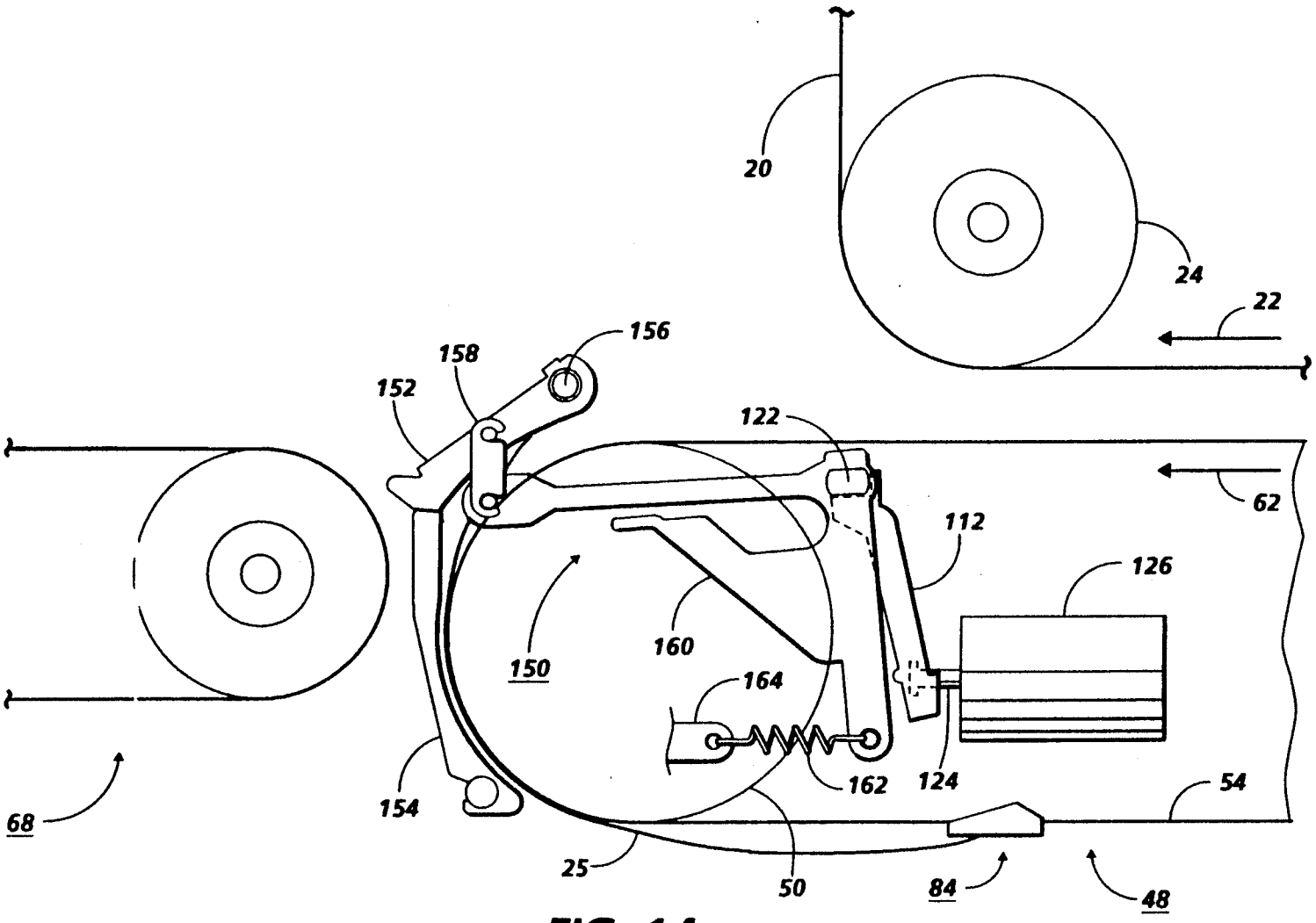
FIG. 14 is a view similar to FIG. 13 but showing the sheet gripper transporting a sheet wherein the trailing edge of the sheet is being guided by the movable guide member.
Figure 15:
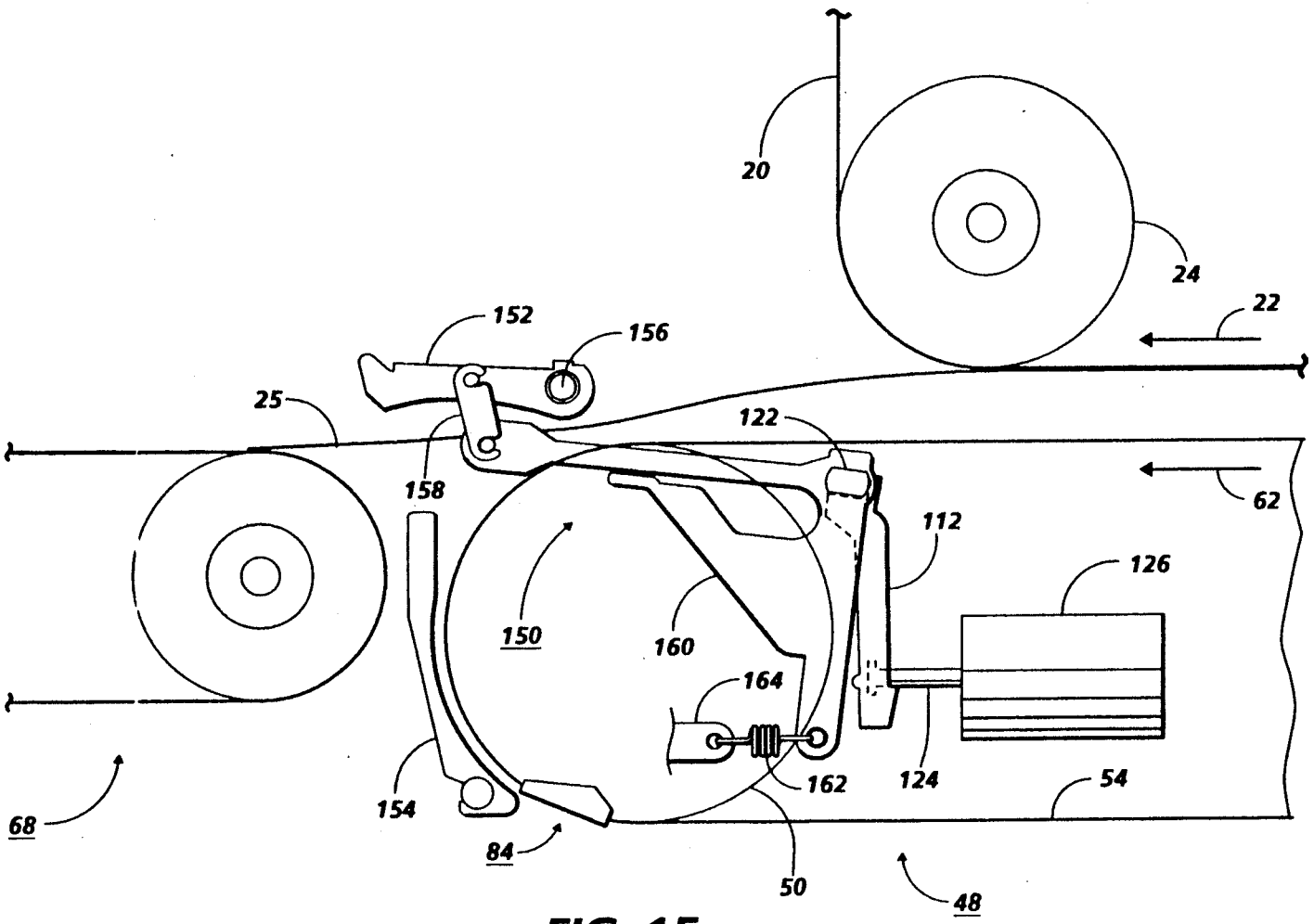
FIG. 15 is a schematic elevational view of the trail edge guide mechanism of the sheet transport system used in the electrophotographic printing machine of FIG. 1 with the movable guide member shown in a second position.

A third mechanism which controls movement of the sheet while its is being advanced in its path is shown in FIGS. 13–15. More specifically, sheet transport mechanism 48 further includes a trail edge guide mechanism, indicated generally by the reference numeral 150, for guiding the trailing edge of sheet 25 around a curved portion of the path in which the sheet is being advanced. Trail edge guide mechanism 150 includes a movable guide member 152 and a stationary guide member 154. Movable guide member 152 is pivotably mounted on a stationary shaft 156. A first connecting link 158 is pivotably attached at one of its ends to movable guide member 152 and also is pivotably attached to a second connecting link 160 at its other end as shown in FIG. 13. Second connecting link 160 is secured to rotatable shaft 122. A spring 162 is connected at one of its ends to a stationary member 164 and at its other end to second link member 160.

When solenoid 126 is in one mode of operation, shaft 124 of the solenoid is positioned so as to maintain movable guide member 152, via first connecting link 158 and second connecting link 160, in physical contact with stationary guide member 154 as shown in FIG. 13. As a result, movable guide member 152 and stationary guide member 154 define a continuous arcuate surface against which the trailing edge of sheet 25 may be guided. In FIG. 13, sheet gripper 84 is shown advancing sheet 25 in the direction of arrow 62. As sheet gripper 84 negotiates around the curved portion of its path of movement, the trailing edge of sheet 25 is guided by the continuous arcuate surface defined by movable guide member 152 and stationary guide member 154 as shown in FIG. 14.

After the sheet gripper has began its third successive cycle, solenoid 126 is actuated to assume another mode of operation. In this mode of operation, shaft 124 is forced to assume another position as shown in FIG. 15. As shaft 124 is forced from its position shown in FIG. 13 to its position shown in FIG. 15, movable guide member 152 is forced from its position shown in FIG. 13 to its position shown in FIG. 15. When solenoid 126 is in this mode of operation, shaft 124 of the solenoid is positioned so as to locate movable guide member 152, via first connecting link 158 and second connecting link 160, to define an opening 166 through which sheet 25 may exit after being released by the sheet gripper. As sheet 25 exits through opening 166 as a result of force applied to it by photoconductive member 20 due to the sheet being tacked thereto as shown in FIG. 15, vacuum transport 68 acquires control of the sheet and subsequently conveys the sheet to fuser station 71 (see FIG. 1).

Referring now to FIGS. 16–18, a movable element of each of the three mechanisms described above is shown positioned relative to each other to illustrate how the three mechanisms are concurrently employed to affect and control movement of the sheet at various times during advancement thereof within the printing machine. FIG. 16 shows sheet gripper 84 advancing sheet 25 in its path of movement. Cam arm 104 of cam mechanism 102, baffle 130 of sheet release mechanism 129, and movable guide member 152 of trail edge guide mechanism 150 are each shown in FIG. 16 and 18 at one of its respective positions. After the sheet gripper has began its third successive cycle, the solenoid is actuated to reposition shaft 124 thereby causing each of the above movable elements to move, via certain respective linkages previously described, from each of their positions shown in FIG. 16 to each of their positions shown in FIG. 17. Once the sheet gripper passes over cam arm 104, the sheet gripper is forced to open and release its grip on the leading edge of sheet 25. Then, as the sheet gripper further advances over baffle 130, the baffle moves to contact the leading edge portion of the sheet so as to force the leading edge thereof out of the nip of the sheet gripper. Also, movable guide member 152 has been forced out of contact with stationary guide member 154 to define opening 166 though which sheet 25 may exit. Since the sheet is still tacked to the photoreceptor, the sheet continues to be advanced, under the guidance of baffle 130, through opening 166 until control thereof is acquired by vacuum transport 68. FIG. 17 shows sheet 25 being guided by baffle 130 through opening 166 toward vacuum transport 68.

In recapitulation, the sheet transport apparatus of the present invention includes three mechanisms which affect and control movement of the sheet while it is being advanced in its path within the printing machine. Each of the three mechanisms are moved into and out of an operative position by a single solenoid.

It is, therefore, apparent that there has been provided in accordance with the present invention, a sheet transport system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for advancing a sheet in a predetermined path comprising:

means for advancing the sheet in the path;

first means for controlling movement of the sheet while it is being advanced in the path, said first controlling means being in contact with the sheet in a first mode of operation of said first controlling means and being spaced apart from the sheet in a second mode of operation of said controlling means;

second means for controlling movement of the sheet while it is being advanced in the path, said second controlling means being in contact with the sheet in a first mode of operation of said second controlling means and being spaced apart from the sheet in a second mode of operation of said second controlling means;

an intermediate member movable between a first location and a second location, each of said first controlling means and said second controlling means being positioned in one of its respective modes of operation in response to said intermediate member being positioned at its first location and being positioned in the other of its respective modes of operation in response to said intermediate member being positioned at its second location; and third means for controlling movement of the sheet while it is being advanced in the path, said third controlling means being in contact with the sheet in a first mode of operation of said third controlling means and being spaced apart from the sheet in a second mode of operation of said third controlling means, and further, said third controlling means being positioned in one of its modes of operation in response to said intermediate member being positioned at its first location and being positioned in the other of its modes of operation in response to said intermediate member being positioned at its second location.

2. The apparatus of claim 1, wherein said first controlling means comprises a sheet gripper, said second controlling means comprises a first sheet guide and said third controlling means comprises a second sheet guide.

3. The apparatus of claim 2, wherein said sheet gripper is mounted for movement in unison with said advancing means.

4. The appratus of claim 2, wherein said first controlling means grips the leading edge of the sheet, said second controlling means guides the leading edge of the sheet and said third controlling means guides the trailing edge of the sheet.

5. A printing machine of the type having a toner image developed on a moving member with a sheet being advanced in a predetermined path through a transfer zone and into registration with the toner image comprising:

means for advancing the sheet in the path;

first means for controlling movement of the sheet while it is being advanced in the path, said first controlling means being in contact with the sheet in a first mode of operation of said first controlling means and being spaced apart from the sheet in a second mode of operation of said first controlling means;

second means for controlling movement of the sheet while it is being advanced in the path, said second controlling means being in contact with the sheet in a first mode of operation of said second controlling means and being spaced apart from the sheet in a second mode of operation; of said second controlling means an intermediate member movable between a first location and a second location, each of said first controlling means and said second controlling means being positioned in one of its respective modes of operation in response to said intermediate member being positioned at its first location and being positioned in the other of its respective modes of operation in response to said intermediate member being positioned at its second location; and third means for controlling movement of the sheet while it is being advanced in the path, said third controlling means being in contact with the sheet in a first mode of operation of said third controlling means and being spaced apart from the sheet in a second mode of operation of said third controlling means, and further, said third controlling means being positioned in one of its modes of operation in response to said intermediate member being positioned at its first location and being positioned in the other of its modes of operation in response to said intermediate member being positioned at its second location.

6. The printing machine of claim 5, wherein said first controlling means comprises a sheet gripper, said second controlling means comprises a first sheet guide and said third controlling means comprises a second sheet guide.

7. The printing machine of claim 6, wherein said sheet gripper is mounted for movement in unison with said advancing means.

8. The printing machine of claim 6, wherein said first controlling means grips the leading edge of the sheet, said second controlling means guides the leading edge of the sheet and said third controlling means guides the trailing edge of the sheet.

* * * * *